US011047647B2

(12) United States Patent
Hahn

(10) Patent No.: US 11,047,647 B2
(45) Date of Patent: Jun. 29, 2021

(54) FIREARM AND METHOD FOR IMPROVING ACCURACY

(71) Applicant: Michael Hahn, Moenchengladbach (DE)

(72) Inventor: Michael Hahn, Moenchengladbach (DE)

( * ) Notice: Subject to any disclaimer, the term of this patent is extended or adjusted under 35 U.S.C. 154(b) by 10 days.

(21) Appl. No.: 16/318,709

(22) PCT Filed: Jun. 21, 2017

(86) PCT No.: PCT/EP2017/065267
§ 371 (c)(1),
(2) Date: Jan. 18, 2019

(87) PCT Pub. No.: WO2018/015096
PCT Pub. Date: Jan. 25, 2018

(65) Prior Publication Data

US 2019/0285381 A1 Sep. 19, 2019

(30) Foreign Application Priority Data

Jul. 19, 2016 (DE) ..... 10 2016 113 262.4

(51) Int. Cl.
*F41G 1/473* (2006.01)

(52) U.S. Cl.
CPC ..... *F41G 1/473* (2013.01)

(58) Field of Classification Search
CPC ..... F41G 1/30; F41G 1/38; F41G 1/40; F41G 1/473
USPC ..... 42/111, 113, 114, 115, 120, 139, 141
See application file for complete search history.

(56) References Cited

U.S. PATENT DOCUMENTS 1,964,027 A * 6/1934 Bliss ..... F41G 1/46 42/141
2,538,821 A * 1/1951 Wheeler ..... F41G 5/08 89/204
2,613,442 A * 10/1952 Austin ..... F41G 1/473 42/139
2,660,794 A * 12/1953 Goertz ..... G06G 7/80 89/205
3,135,053 A * 6/1964 Newman ..... F41G 5/08 89/202
3,434,213 A * 3/1969 Lauder ..... F41G 1/473 42/139
3,685,159 A * 8/1972 Erhard ..... F41G 3/06 89/204
3,766,826 A * 10/1973 Salomonsson ..... F41G 3/06 89/41.17
4,004,729 A * 1/1977 Rawicz ..... F41G 5/08 235/404
4,020,407 A * 4/1977 Clement ..... F41G 3/06 318/601
5,456,157 A 10/1995 Lougheed et al.
(Continued)

FOREIGN PATENT DOCUMENTS

DE 10 2008 015 423 A1 10/2008
DE 10 2015 012 206 A1 3/2017

*Primary Examiner* — Stephen Johnson
*Assistant Examiner* — Benjamin S Gomberg
(74) *Attorney, Agent, or Firm* — Norman B. Thot

(57) ABSTRACT

A firearm includes a sighting device with a sight line and a first device which detects a movement of the firearm in a horizontal plane, and a second device which alters a course of the sight line depending on the movement detected by the first device.

17 Claims, 7 Drawing Sheets

(56) References Cited

U.S. PATENT DOCUMENTS

| | | | | |
|---|---|---|---|---|
| 6,252,706 | B1 | 6/2001 | Kaladgew | |
| 7,121,036 | B1 * | 10/2006 | Florence | F41A 17/08 42/123 |
| 7,225,578 | B2 * | 6/2007 | Tai | F41G 1/30 33/334 |
| 7,328,531 | B2 * | 2/2008 | Dietz | F41G 1/473 42/133 |
| 7,656,579 | B1 * | 2/2010 | Millett | F41G 3/165 359/400 |
| 7,909,253 | B2 * | 3/2011 | Sherman | G06K 9/3216 235/454 |
| 8,100,044 | B1 * | 1/2012 | Teetzel | F41G 3/06 235/414 |
| 9,316,464 | B2 * | 4/2016 | Frederick | F41G 11/004 |
| 9,395,156 | B2 * | 7/2016 | Newzella | F41G 1/01 |
| 10,634,454 | B2 * | 4/2020 | Pautler | F41G 1/473 |
| 2008/0048033 | A1 | 2/2008 | Quinn | |
| 2011/0162250 | A1 | 7/2011 | Windauer et al. | |
| 2012/0000979 | A1 | 1/2012 | Horvath et al. | |
| 2013/0169820 | A1 * | 7/2013 | Stewart | F41G 3/2605 348/169 |
| 2014/0283429 | A1 * | 9/2014 | Sullivan | F41G 11/003 42/111 |
| 2015/0106046 | A1 | 4/2015 | Chen et al. | |
| 2015/0323286 | A1 * | 11/2015 | Theriault | F42B 12/38 42/111 |
| 2016/0169621 | A1 * | 6/2016 | Geva | F41G 1/40 42/118 |
| 2017/0227328 | A1 | 8/2017 | Newzella | |

* cited by examiner

FIREARM AND METHOD FOR IMPROVING ACCURACY

CROSS REFERENCE TO PRIOR APPLICATIONS

This application is a U.S. National Phase application under 35 U.S.C. § 371 of International Application No. PCT/EP2017/065267, filed on Jun. 21, 2017 and which claims benefit to German Patent Application No. 10 2016 113 262.4, filed on Jul. 19, 2016. The International Application was published in German on Jan. 25, 2018 as WO 2018/015096 A1 under PCT Article 21(2).

FIELD

The present invention relates to a firearm, in particular to a hunting rifle as used in battue hunting, which is equipped with an aiming or sighting device having a sight line, and to a method for improving the accuracy that can be achieved using a firearm when firing at a target moving in a horizontal direction, a sight line being aimed at the target.

BACKGROUND

In cases of targets moving with a motion component in a horizontal direction and transversely to the firing direction, the point at which the sight line of a sighting device is aimed must lead the target in order to compensate for the transverse movement thereof during the flight time of a bullet fired by the firearm. "Firearm" in particular refers to hunting rifles used, for example, in battue hunting in which shots are fired at game moving with a travelling component transversely to the firing direction.

The size of the lead is substantially dependent on the following three parameters:

a) Target's travelling velocity transversely to the firing direction, b) Distance from the firearm to the target, and c) Velocity of the bullet.

In a battue hunt, for example, it is often difficult to calculate the lead in practice since only the velocity of the bullet is known before firing a shot, but not the distance from the firearm or shooter to the target or the velocity at which the target (in this case the game) is moving, e.g., transversely to the firing direction, before the shot is fired. Distances of, for example, between 40 and 150 m between the game at which the shot is fired and the shooter or firearm, and velocities of, for example, between 5 km/h and 45 km/h of the game transversely to the firing direction are absolutely conceivable.

SUMMARY

An aspect of the present invention is to develop a firearm comprising a sighting device having a sight line so that, by using simple technical means, the accuracy when firing at a target moving with a motion component in a horizontal direction and transversely to the firing direction is improved, and also to provide a corresponding method therefor.

In an embodiment, the present invention provides a firearm which includes a sighting device comprising a sight line and a first device which is configured to detect a movement of the firearm in a horizontal plane, and a second device configured to alter a course of the sight line depending on the movement detected by the first device.

BRIEF DESCRIPTION OF THE DRAWINGS

The present invention is described in greater detail below on the basis of embodiments and of the drawings in which.

DETAILED DESCRIPTION

Figure 1:
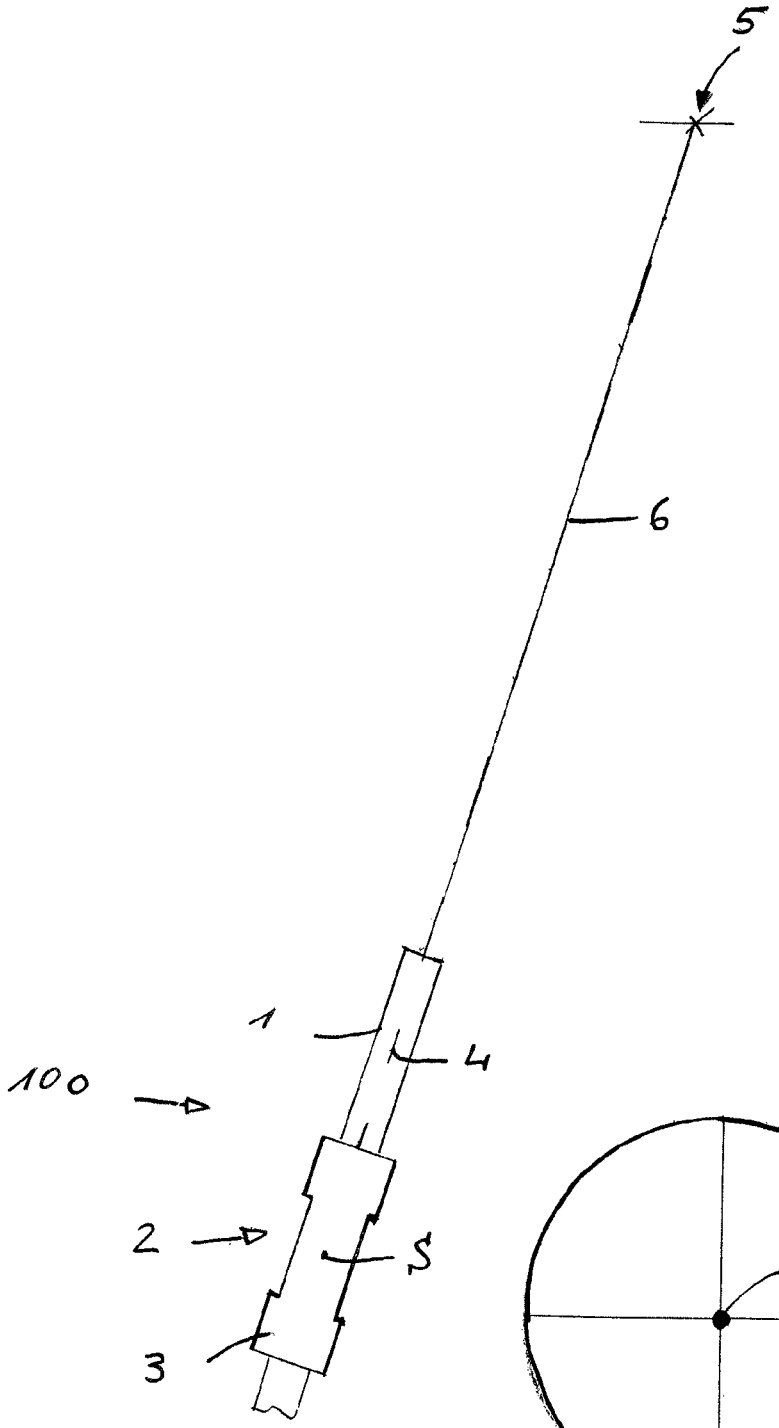
FIG. 1 shows a purely schematic partial view of a firearm equipped with a sighting device when firing at a stationary target, in a view perpendicular to the firing direction.

The firearm according to the present invention comprising a sighting device having a sight line comprises a device for detecting a movement of the firearm in a horizontal plane, in particular a device for detecting a pivot movement of the firearm in the horizontal plane. "Horizontal plane" should be understood as the plane in which the shooter must pivot the firearm in order to keep the sight line on a target, for example, passing game, moving with a motion component transversely to the firing direction. To prevent the shooter from having to select an aim point in front of the game, for example, based on the movement direction thereof despite the motion component of the game, and to allow the shooter to instead keep the sight line aimed at the game, the present invention provides a device for altering the course of the sight line relative to the firing direction depending on the movement detected via the device for detecting the movement of the firearm.

For this purpose, the device for altering the course of the sight line can, for example, be designed so that, when a movement of the firearm in the horizontal plane is detected, the course of the sight line is altered by a predetermined angular amount counter to the movement direction. The shooter can, for example, preset this angular amount, for example, in a range of 1.2° to 1.5°, for example, in a range of 0.5° to 2.5°, for example, in a range of 0° to 5.0°. It has surprisingly been found that, in many battue hunting situations, adjusting the angular amount between 1.2° and 1.5° is suitable for significantly increasing accuracy even though the velocity at which game passes the shooter during a battue hunt and the distance from the firearm to the game when the shot is fired can vary greatly, as mentioned above. The inventor has found that an angular amount from this angular range is nonetheless capable of increasing accuracy, possibly due to the fact that in most cases the velocity of the motion components of the game transversely to the firing direction in reality varies between 5 km/h and 10 km/h.

The sighting device can comprise a telescopic sight.

The sighting device, which can, for example, comprise a telescopic sight, can be mounted, for example, to pivot about a pivot axis extending approximately perpendicularly to the sight line. The device for altering the course of the sight line can, for example, be operatively connected to the telescopic sight so that the telescopic sight can be pivoted about the pivot axis by the device.

The device for altering the course of the sight line can additionally or alternatively pivot the course of the line about the pivot axis relative to the sighting device.

If the sighting device is a telescopic sight, the device for altering the course of the sight line can be arranged between an objective lens and an ocular lens of the telescopic sight and can comprise an optical member that determines the course of the sight line. In other words, the course of the sight line can be altered by pivoting the sighting device relative to firing direction about a pivot axis extending approximately perpendicularly to the sight line and/or by altering the course of the sight line relative to the sighting device.

The device for altering the course of the sight line can, for example, comprise an optical member, in particular a mirror, a projection surface or a light source, that determines the course of the sight line. The sight line can thereby be altered relatively simply by shifting the optical member. For example, by shifting a mirror arranged in or on the sighting device or a projection surface, a reticle, graticule or marker point, e.g., a light spot, that is displayed in a field of vision or field of view of the sighting device and determines the sight line can be displaced sideways by a preset distance, i.e., a fixed distance or one having a fixed value, from a point position that coincides to the firing direction or firing line, so that the sight line deviates from the firing line at a predefined angle. The marker point can also be displaced by a preset distance relative to the point position that coincides with the firing line by shifting a light source, for example, a light source generating the marker point. The light source can, for example, be shifted by rotating the light source, by partially dimming the light source, or via a plurality of light sources that can be actuated independently of one another. The light source can, for example, be formed as a light-emitting diode.

The device for altering the course of the sight line can, for example, comprise an electrically operable servo-drive or servomotor. The course of the sight line can thus be altered particularly simply automatically in a motor-driven manner. The servomotor can, for example, be designed having a preset, i.e., a fixed, angular working range. The angular working range thus specifies the rotational working range of the servomotor and can, for example, be defined to actuate a predetermined first sight line, for example, a sight line oriented to the left in the field of view, and a predetermined second sight line, for example, a sight line oriented to the right in the field of view. The sighting device can have an energy store, e.g., a battery pack, to operate the servomotor.

To alter the course of the sight line, the servo-drive or servomotor can, for example, be operatively connected to an adjustment device arranged on the sighting device for setting an optical marker or indication that determines the course of the sight line, and the adjustment device can be shifted in a motor-driven manner via the servomotor. The automatic alteration of the course of the sight line can thus be used, for example, on any commercially available telescopic sight or target optics. In telescopic sights of this kind, the marker or indication can be designed as a reticle, crosshair or aiming dot, which can usually be set by at least one adjustment device, e.g., an adjusting screw. The adjustment device in this case is mostly arranged on the side of a sighting device and can in most cases influence the position of the marker or indication in the horizontal and/or vertical direction via a spring exerting a counterforce. The adjustment is generally carried out when manually calibrating the sighting device in accordance with the firing direction of the weapon, for example, by rotating the adjusting screw. In an advantageous embodiment, the servomotor can, for example, be mounted on the adjustment device, for example, by a latch connection thereto, or can be locked on the sighting device and can shift the adjustment device according to an actuation. The arrangement of the servomotor can therefore, for example, cause a rotation of the adjusting screw and thus a displacement of the marker or indication in the field of vision or field of view of the sighting device, as well as displacement of the sight line.

The device for altering the course of the sight line can, for example, comprise at least one light source capable of producing or generating, within a field of vision of the sighting device, at least two light spots that can be preset, for example, during a calibration, the at least two light spots being arranged so as to be stationary during use of the weapon, substantially horizontally next to one another, to be spaced apart from one another, and to each determine a course of the sight line, the light source being actuable depending on the movement detected by the device for detecting the movement of the firearm so that only a light spot previously assigned to the particular detected movement direction is generated and the other light spots are not illuminated or are not generated. In other words, the device for altering the course of the sight line comprises at least two stationary light spots that can be displayed independently of one another within a field of vision of the sighting device by at least one light source, each of which determine a course of the sight line and each of which can be actuated to light up depending on the detected movement direction. The sight line can therefore be altered particularly simply merely by actuating either a light source to illuminate a predefined light spot or a reflection element for reflecting a light beam producing the light spot. A design of this kind can, for example, be used for sighting devices formed as compact reflex sights. The light spot need not necessarily be in the form of a spot, but can also take any shape, for example a reticle, crosshair or a dot surrounded by a circle. The light spot can also be displayed in white, black or any other color. A light spot arranged in the center in the firing direction can, for example, have a different color from a light spot arranged elsewhere than in the firing direction. The expression "can be displayed" in the present case should be understood to mean an indication or illumination in the field of vision; for example, a light beam hitting a transparent projection surface, such as a glass surface or a lens, can cause the formation of a light spot on the projection surface. A total of three light spots, i.e., a first light spot arranged in the firing line, a second light spot displaced to the left of the firing line, and a third light spot displaced to the right of the firing line, can advantageously be generated independently of one another on one projection surface located within the field of vision of the sighting device; in all cases, only one of the light spots is generated or illuminated and the other light spots are not generated or illuminated. The light spots can, for example, be arranged substantially horizontally next to one another and can each be at a preset, in particular a fixed, distance from one another or have a fixed position. The first and second light spot can, for example, be at the same distance from one another as the second and third light spot. Depending on the detection of movement of the firearm, therefore, the second light spot or third light spot can be generated or illuminated, whereas the two other light spots remain unilluminated. A shooter can as a result make the sight line defined by the generated light spot coincide with or overlap a target, and a lead in front of a moving target can automatically be taken into account due to the firing direction now deviating from the sight line. If the firearm is pivoted from right to left, for example, as may occur if the target moves from right to left, the third light spot, which is displaced to the right, is generated or illuminated; accordingly, if the firearm is pivoted from left to right, the second light spot, which is displaced to the left, is generated. The sighting device can have an energy store such as a battery pack to operate the at least one light source.

A plurality of separate light sources each capable of generating a light source can, for example, be arranged in the sighting device. In other words, each light spot can be generated via a separate light source. The sight line can thus be altered solely by electronic actuation, in particular without two components moving relative to one another and in particular without any motor-driven movement, The sighting device is thereby particularly cost-effective to produce, particularly sturdy, and durable, and can be operated in a particularly low-energy manner. An integrated circuit can be provided to actuate any individual light source. The sight line can thus be altered particularly simply, specifically solely by electrically actuating any individual light source.

The device for detecting the movement of the firearm can comprise an electromechanical or electronic movement sensor of a known design.

In the method according to the present invention for improving the accuracy that can be achieved using the firearm when firing at a target that is moving transversely to the firing direction with a horizontal motion component, a sight line being aimed at the target, the course of the sight line is altered by a presettable angular amount counter to the movement direction if the firearm is moved in a horizontal plane, in particular is pivoted in a horizontal plane.

The angular amount can, for example, be preset in a range of 1.2° to 1.5°, for example, in a range of 0.5° to 2.5°, for example, in a range of 0° to 5.0°.

The present invention will be explained further below based on the drawings which illustrate three embodiments in a purely schematic manner.

Figure 2:
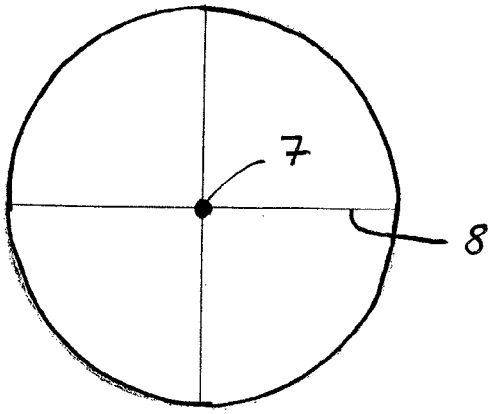
FIG. 2 shows the position of the point of aim when looking through the telescopic sight.

In a first embodiment of the present invention explained on the basis of FIGS. 1 and 2, a firearm 100, of which only a part of a barrel 1 is shown purely schematically, comprises a sighting device 2 designed as a telescopic sight 3. The sighting device 2 defines a sight line 4, which is illustrated as a dash-dot line in FIG. 1. The device is aimed at a target 5, which in FIG. 1 is immovable transversely to the firing direction 6, which is shown as a solid line. To hit the target 5, which is immovable transversely to the firing direction 6, the sight line 4 and the firing direction 6 must overlap in the view according to FIG. 1. If other influencing variables that cause deviations between the sight line 4 and the firing direction 6, for example, the earth's gravity and wind, are disregarded, a point of aim 7, i.e., the point at which the sight line 4 hits the target 5, appears when viewed through the telescopic sight 3 in the center of a reticle 8 in the telescopic sight 3 image shown schematically in FIG. 2.

Figures 3, 4:
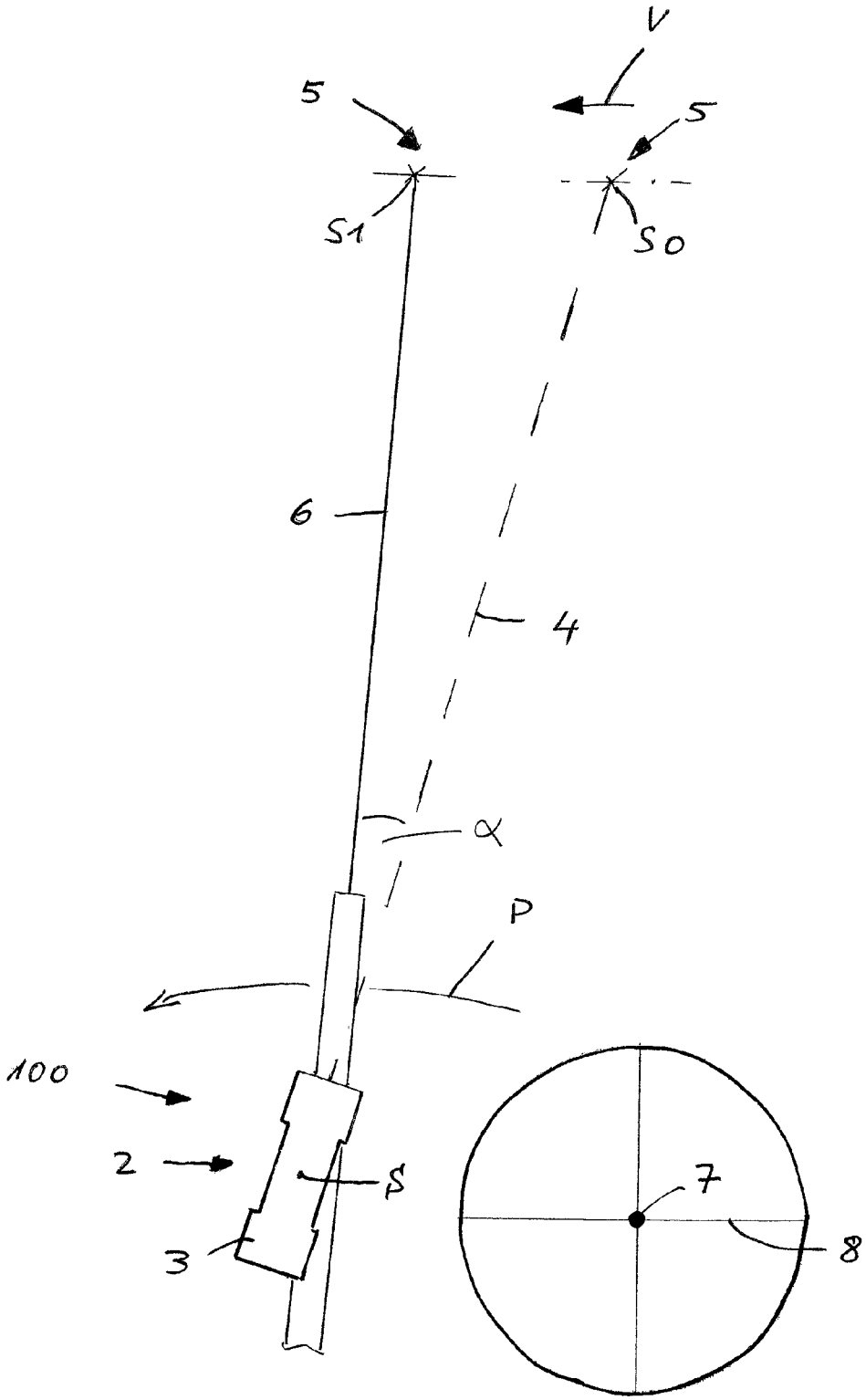
FIG. 3 shows a view corresponding to FIG. 1 when the target is moving from right to left in accordance with the drawing.
FIG. 4 shows the position of the point of aim when looking through the telescopic sight.

If, as shown purely schematically in FIG. 3, the target 5 now moves at a velocity V from right to left in accordance with the plane of the drawing, this means that the target 5 moves from the position S0 to position S1 in the period between the shot being fired and the bullet fired hitting the target 5. Whereas the target 5 appears at position S0 when viewed through the telescopic sight 3 in the direction of the sight line 4 when the shot is fired, the firing direction 6 must deviate from the sight line 4 in the direction of the velocity V by an angle $\alpha$ so that the bullet hits the target 5 at position S1. To increase accuracy, in the embodiment of the firearm according to the present invention shown in FIGS. 1 and 3, the sighting device 2 is mounted to the barrel 1 so as to be pivotable about an axis S extending approximately perpendicularly to the sight line 4. In addition, a device (not shown in the drawings) for altering the course of the sight line 4 is provided and designed so that, when a movement of the firearm in a horizontal plane is detected (in a direction intended to be symbolized by the arrow P), in particular when a pivot movement about which a shooter moves the firearm when following the moving target 5 with the sight line 4 is detected, the aiming device 2 is pivoted about the axis S so far that the firing direction 6 forms a predetermined angle $\alpha$ relative to the sight line 4. The device for altering the course of the sight line 4 is designed so that the shooter can preset the angle $\alpha$. In battue hunting, it should be suitable for the firing direction 6 to be ahead of the sight line 4 in the movement direction of the target 5 by an angular value from the range of 1.2° to 1.5° in order for the bullet to strike, at position S1, the target 5 travelling with a motion component transversely to the firing line when the target 5 is aimed at in position S0 using the sight line 4.

A second embodiment of the present invention will now be explained with reference to FIGS. 5 to 8. This second embodiment comprises a firearm 200 having a barrel 101 and a sighting device 102, which again is designed as a telescopic sight 103. Unlike the first embodiment, the sighting device 102 in the second embodiment cannot pivot about an axis extending perpendicularly to the sight line 104 of the sighting device 102, but in this respect is rather arranged immovably relative to the barrel 101. A device (not shown in the drawings) for detecting a movement of the firearm 200 in a horizontal plane, in particular for detecting a pivot movement P of the firearm 200 in a horizontal plane, as well as a device for altering the course of the sight line 104 depending on the movement relative to the firing direction 106 as detected by the device for detecting the movement of the firearm 200, are again provided. As is evident from comparing FIG. 5, which shows the situation for a stationary target 105 as in FIG. 1, with FIG. 8, which shows the situation for a target 105 moving from right to left in accordance with the drawing at the velocity V, as in FIG. 3, the device (not shown in the drawings) for altering the course of the sight line 104 causes the line to be moved within the telescopic sight 103 by an angle $\alpha$ relative to the firing direction 106 in order to achieve the same effect as pivoting the telescopic sight 103 about the axis S in the first embodiment. For this purpose, the device for altering the course of the sight line 104 within the telescopic sight 103 can be arranged between the ocular lens 109 and the objective lens 110, and can comprise an optical member that determines the course of the sight line 104 and is operatively connected to the device or detecting a pivot movement of the firearm in a horizontal plane. In this embodiment, and as shown schematically in FIG. 7, the point of aim 107 travels to the right relative to the reticle 108 of the telescopic sight 103.

In order to increase the accuracy for a moving target 105 in this embodiment, the point at which the firearm is aimed should be selected so that the point of aim 107 is located on the target 105 during the pivot movement in the direction of the arrow P. Alternatively, the entire reticle 108 is moved and the point of aim 107 remains in the center of the reticle 108. This variant is shown in dashed lines in FIG. 7.

It goes without saying that it is also part of the present invention to pivot both the sight line 104 within the telescopic sight 103 and the telescopic sight 103 itself about the axis S relative to the firing direction 106 when a pivot movement of the firearm in a horizontal plane is detected. This is particularly expedient, for example, when the sight line 104 is supposed to be moved relative to the firing line by a relatively large angle $\alpha$ that cannot be achieved solely by altering the course of the sight line 104 within the telescopic sight.

Figure 5:
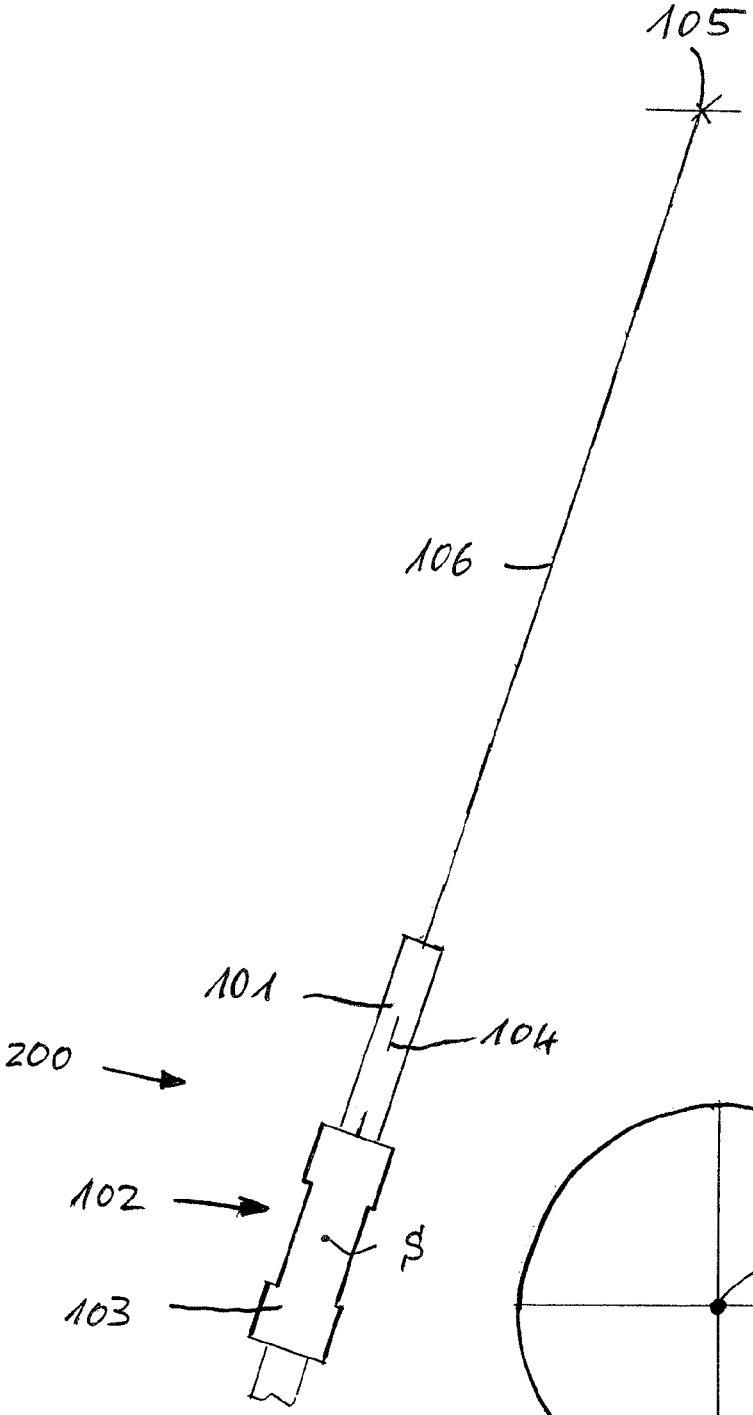
FIG. 5 shows a view corresponding to FIG. 1 of a second embodiment of the present invention.
Figure 6:
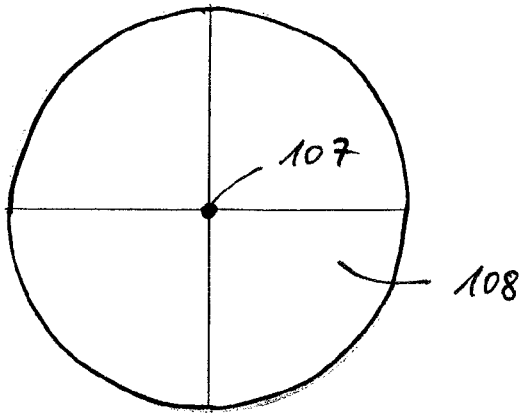
FIG. 6 shows the position of the point of aim when looking through the telescopic sight.
Figures 7, 8:
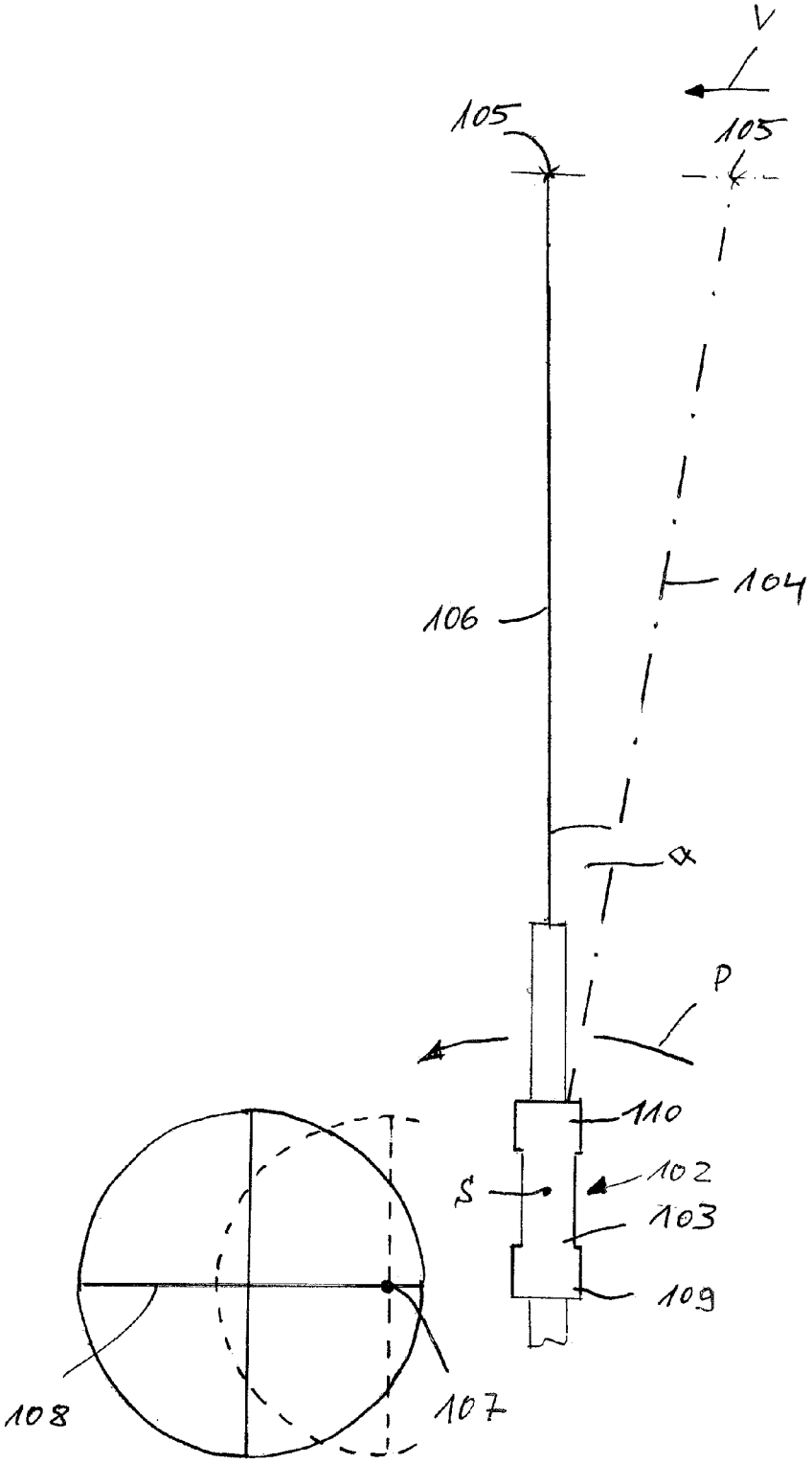
FIG. 7 shows the position of the point of aim or a reticle when looking through the telescopic sight.
FIG. 8 shows a view corresponding to FIG. 3 showing a target moving from right to left in accordance with the drawing.
Figure 9:
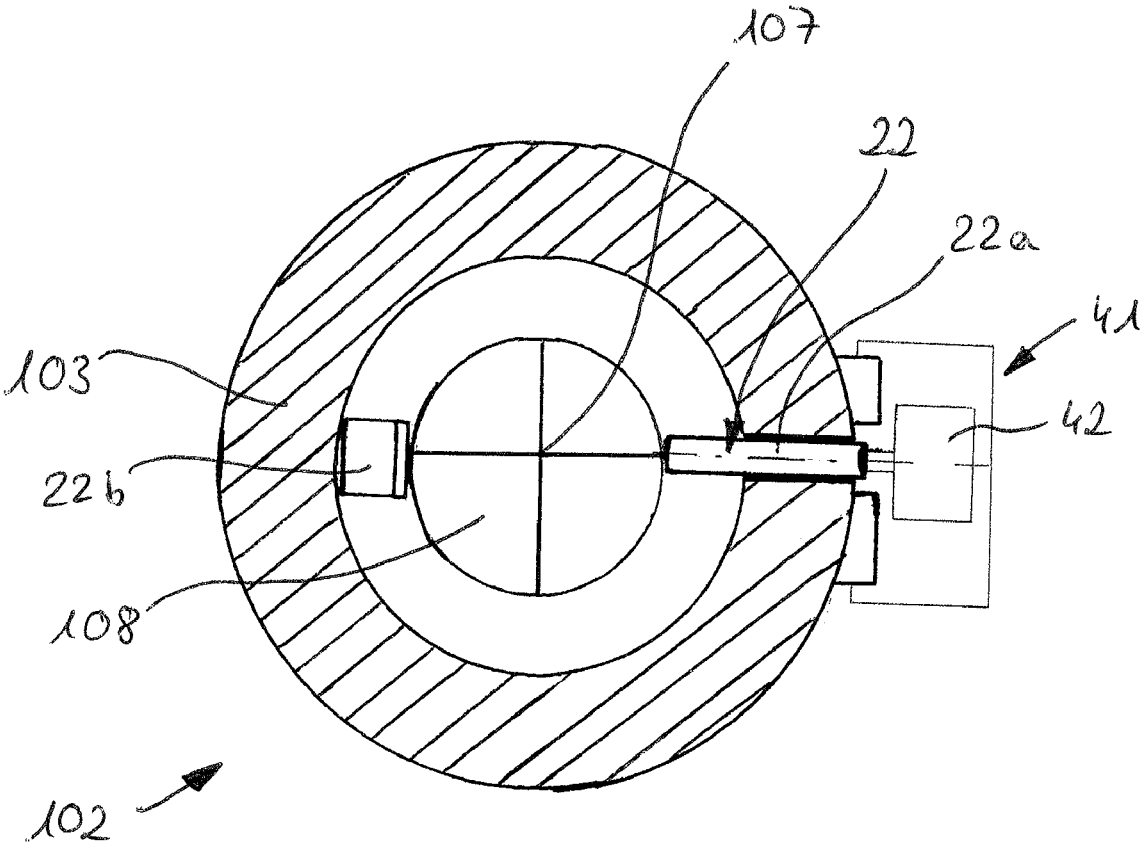
FIG. 9 shows a frontal sectional view through a design according to the present invention of the telescopic sight from FIGS. 5 and 8.

FIG. 9 shows an embodiment of the sighting device 102 from FIGS. 5 and 8, designed as a telescopic sight 103, in a frontal sectional view. The telescopic sight 103 is designed as a commercially available telescopic sight 103 and comprises an adjustment device 22 arranged in the longitudinal extension between an ocular lens and an objective lens. The adjustment device 22 is used to set the reticle 108, for example, when calibrating the weapon. To aid clarity, in this case only the adjustment device 22 arranged in the horizontal plane is shown; in principle, a telescopic sight 103 also comprises another adjustment device (which is not shown in this case) in the vertical plane. The adjustment device 22 comprises an adjusting screw 22*a* that is rotatably mounted on a housing of the telescopic sight 103 and abuts a component having the reticle 108 (such as a lens or a glass optics) via an end face arranged within the telescopic sight 103. A spring element 22*b* for preloading the glass optics counter to the adjusting screw 22*a* is arranged on a side of the glass optics opposite the adjusting screw 22*a*. The glass optics is thus movably preloaded and held between the spring element 22*b* and the adjusting screw 22*a* counter to the spring force of the spring element 22*b*. When the adjusting screw 22*a* is rotated, the reticle 108 can thus be displaced in the horizontal plane.

To automatically alter the sight line 104 for a moving target 105, as shown, for example, in FIGS. 7 and 8, the sighting device 102 has a device 41 that alters the sight line 104 by changing the position of the reticle 108 depending on the movement P detected by a device (not shown in the drawings) for detecting the movement of the firearm 200. For this purpose, the device 41 comprises a servo-drive 42, in particular an electrical servomotor 42, operatively connected to the adjusting screw 22*a* via a shaft. The adjusting screw 22*a* can thereby be rotated in a motor-driven manner by the servomotor 42 over a predetermined, in particular fixed, range, or a range having a fixed value, whereby the reticle 108 is moved in the horizontal plane. As in the previous examples, the field of view can thus be moved sideways in the target 105 or striking plane by a particular value, for example by 1 m, so that the shooter aiming at the target 105 automatically gives the weapon a lead. The device 41 can, for example, be fastened to the housing of the telescopic sight 103 by a latch connection (not shown in more detail). A battery pack (which is not shown in the drawings) can, for example, be arranged on the sighting device 102 to power the servo-drive 42.

Figure 10:
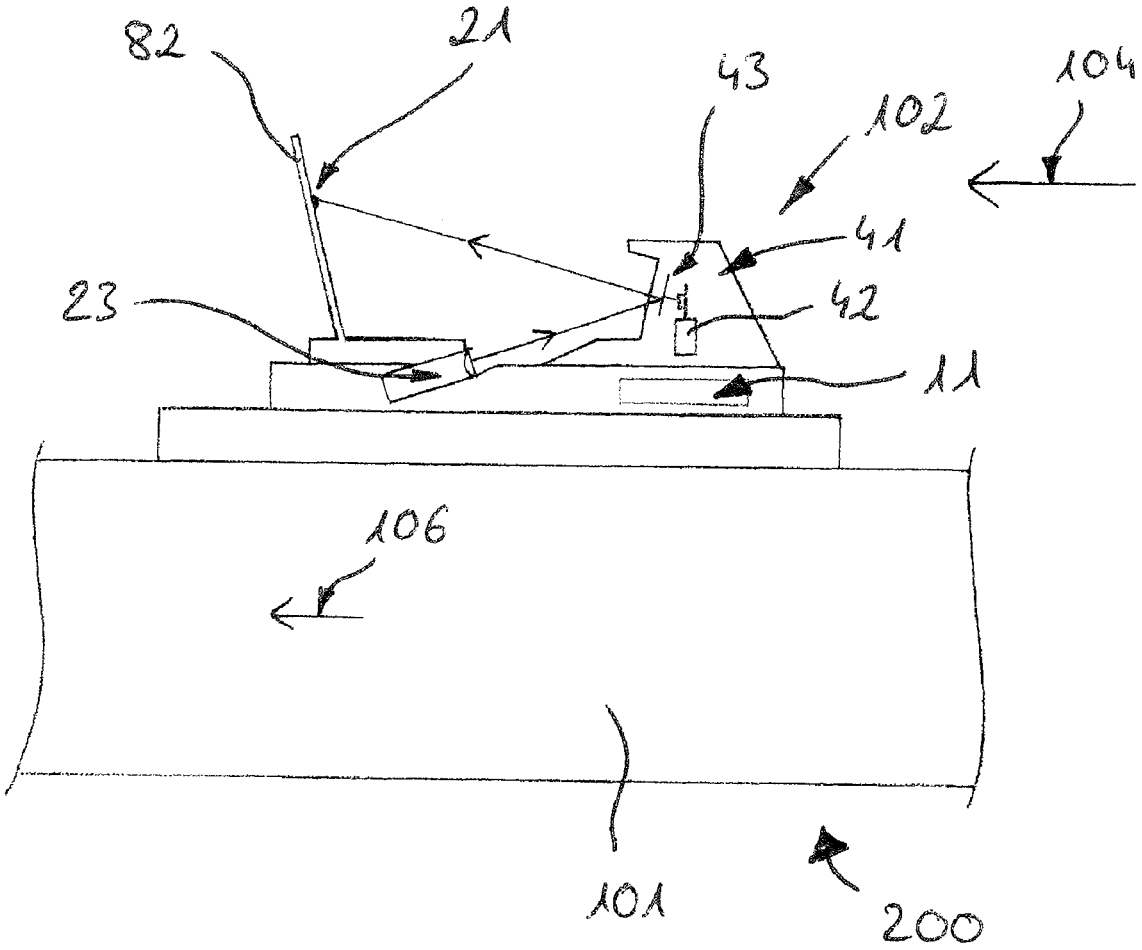
FIG. 10 shows a lateral sectional view through a design according to the present invention of a further sighting device.

FIG. 10 is a lateral sectional view through an embodiment of a further sighting device 102. The sighting device 102 is formed substantially as a compact reflex sight, which can, for example, be used in handguns. The sighting device 102 in this case is fastened via a clamping apparatus (not shown in more detail) to a rail (not shown in more detail in this case), for example, a dovetail rail, e.g., a Weaver or Picatinny rail, so as to be able to be shifted in the longitudinal direction above a weapon barrel 101. The sighting device 102 substantially comprises a projection surface 82 which can be formed as a glass optics, for example, a transparent disc or lens, a light source 23, for example, a light-emitting diode, and an optical member or reflection element 43, for example, a mirror. A light beam emitted by the light source 23 substantially counter to a firing direction 106 and shown in this case by a line having arrows is reflected on the reflection element 43 substantially in the direction of the firing direction 106, and causes the formation of a light spot 21 when it strikes the projection surface 82 arranged in a field of vision 81 of the shooter. The light spot 21 formed on the projection surface 82 need not necessarily be in the shape of a dot, but can rather be provided as any shape via an appropriate filtering, for example, as a minimized reticle, a crosshair, or as a dot surrounded by a ring. The position of each light spot 21 on the projection surface 82 can be preset during a calibration process, but is stationary, in particular does not change, when the firearm 200 and the device 41 are used when hunting.

When the firearm 200 comprising the device 41 is used when hunting, in order to automatically adapt the sight line 104 to a hunting situation such as a moving target 105, the light spot 21 can be displaced by shifting the reflection element 43 in a horizontal plane. According to the present invention, this is done depending on a movement P of the firearm 200, which in this case can be detected by device 11. The device 11 can be designed, for example, as an electromechanical or electronic movement sensor. The reflection element 43 is in this case shifted automatically by the device 41, in particular by an electric servomotor 42. As a result, as soon as the device 11 detects movement P of the firearm 200, in particular a pivoting of the firearm 200 in the horizontal plane, an actuation signal is sent to the servomotor 42, and then the reflection element 43 is shifted by a predefined angle.

In an alternative embodiment of the sighting device 102, the reflection element 43 can be arranged in a stationary manner and the light beam can be altered directly either by or at the light source 23, for example, by rotating the light source 23 or dimming a portion of the light source 23.

In another alternative embodiment of the sighting device 102, the reflection element 43 can also be stationary and at least two separate light sources 23 can be arranged for generating one light spot 21*a*, 21*b*, 21*c* each. A servomotor 42 is not required in this embodiment and no movably arranged components exist so that the sighting device 102 is particularly sturdy and particularly cost-effective to produce.

Figure 11:
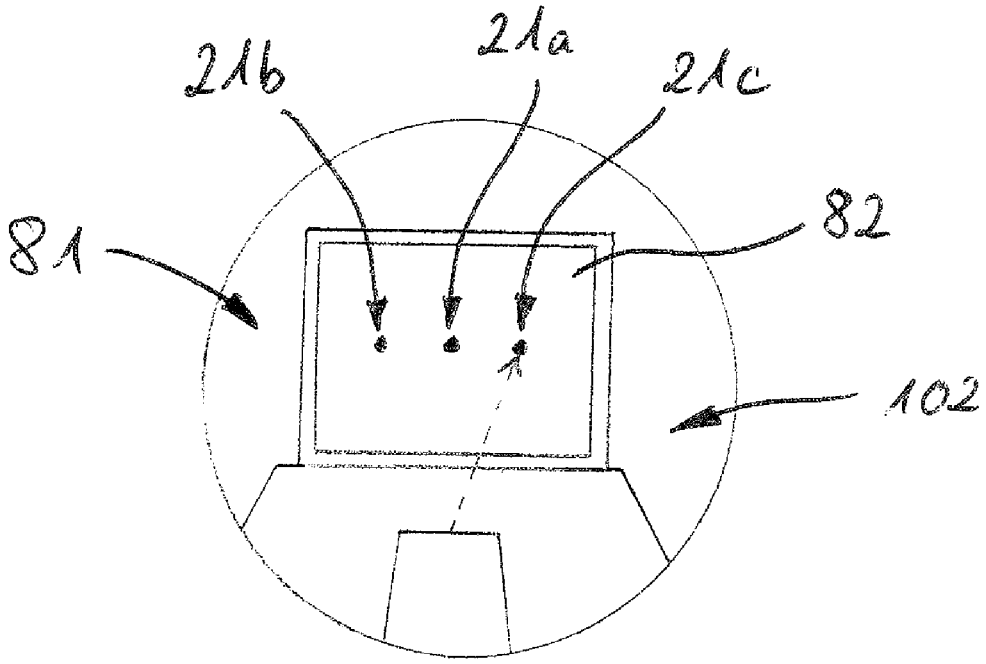
FIG. 11 shows a detail of a frontal view of the sighting device from FIG. 10.

FIG. 11 shows a detail of a front view of the sighting device 102 according to FIG. 10, specifically a detail of a viewing angle of a shooter operating the firearm 200, substantially in the firing direction 106. In this case, a total of three light spots 21*a*, 21*b*, 21*c* each determining a course of the sight line 104 can be generated, in the aforementioned manner, on the projection surface 82 by the at least one light source 23 and the reflection element 43. In the situation shown in FIG. 11, only the light spot 21*c* is generated by the light beam of the light source 23 (shown in the dashed line) or is visible on the projection surface 82. The light spots 21*a* and 21*b*, which are shown in this case solely to aid understanding, are not generated or are not visible on the projection surface 82. In this situation, the device 11 has detected beforehand that the firearm 200 has pivoted from right to left in the horizontal plane when viewed from the position of the shooter, and an actuation signal has been output to the servomotor 42 to shift the reflection element 43 so that the light spot 21 is moved to the right out of the neutral position 21*a* and into the corrected position 21*c*, for example, by the light spot 21*a* (and the light spot 21*b*) not being illuminated and the light spot 21*c* being illuminated. When the shooter aims at the target 105 (not shown in the drawing), the firearm 200 is therefore pivoted from right to left so that the light spot 21*c* can be made to optically coincide with or overlap the target 105 (not shown in more detail) and the barrel 101 of the firearm 200 can thus automatically have a predefined lead in front of the moving target 105. As already explained with reference to FIG. 10, in this case the reflection element 43 can also alternatively be stationary and the position of the light spot 21 changed by altering the light beam at the light source 23, or by a plurality of separate light sources 23 each generating one light spot 21*a*, 21*b*, 21*c*.

It should be clear that the scope of protection of the present invention is not limited to the embodiments described and/or feature combinations shown. The construction and the design of the sighting device and of the device for altering the course of the sight line can absolutely be modified without changing the core concept of the present invention. Reference should also be had to the appended claims.

LIST OF REFERENCE NUMERALS

100, 200 Firearm
1, 101 Barrel
11 Device for detecting a movement of the firearm
2, 102 Sighting device
21, 21*a*, 21*b*, 21*c* Marker, light spot
22 Adjustment device
22*a* Adjustment screw
22*b* Spring element
23 Light source
3, 103 Telescopic sight
4, 104 Sight line
41 Device for altering the course of the sight line
42 Servo-drive, servomotor
43 Optical member/Reflection element
5, 105 Target
6, 106 Firing direction
7, 107 Point of aim
8, 108 Reticle
81 Field of vision, field of view
82 Projection surface
109 Ocular lens
110 Objective lens
P Arrow/Movement
S Axis
V Velocity
α Angle

The invention claimed is:

1. A firearm comprising:
a sighting device comprising a sight line and a first device which is configured to detect a movement of the firearm in a horizontal plane; and
a second device configured to alter a course of the sight line depending on the movement detected by the first device,
wherein,
the second device alters the course of the sight line by a fixed, angular amount which is counter to the direction of the movement of the firearm in the horizontal plane, and
the fixed, angular amount is determined prior to the direction of the movement of the firearm in the horizontal plane by the first sighting device.

2. The firearm as recited in claim 1, wherein the firearm is a hunting rifle.

3. The firearm as recited in claim 1, wherein the movement detected by the first device is a pivot movement of the firearm in the horizontal plane.

4. The firearm as recited in claim 1, wherein the fixed, angular amount is preset at a value of from 0° to 5.0°.

5. The firearm as recited in claim 1, wherein,
the sighting device is mounted to be pivotable about a pivot axis which extends perpendicular to the sight line, and
the second device is operatively connected to the sighting device and is further configured to pivot the sighting device about the pivot axis.

6. The firearm as recited in claim 1, wherein the sighting device is configured so that the sight line can be pivoted relative to the sighting device about a pivot axis which extends perpendicular to the sight line via the second device.

7. The firearm as recited in claim 1, wherein the sighting device comprises a telescopic sight.

8. The firearm as recited in claim 7, wherein,
the telescopic sight comprises an objective lens and an ocular lens, and
the second device is arranged between the objective lens and the ocular lens.

9. The firearm as recited in claim 1, wherein the second device comprises an optical member which is configured to determine the course of the sight line.

10. The firearm as recited in claim 9, wherein the optical member is a mirror, a projection surface or a light source.

11. The firearm as recited in claim 1, wherein the second device comprises an electrically operable servo-drive.

12. The firearm as recited in claim 11, further comprising:
an adjustment device arranged on the sighting device, wherein,
the electrically operable servo-drive is operatively connected to the adjustment device to set a marker or an indication that determines the course of the sight line, and
the adjustment device is configured to be shifted by the electrically operable servo-drive to alter the course of the sight line.

13. The firearm as recited in claim 1, wherein the second device comprises at least one light source which is configured to,
generate, within a field of vision of the sighting device, at least two presettable, stationary light spots that are arranged substantially horizontally next to one another, that are spaced apart from one another, and that each respectively determine the course of the sight line, and
be actuable depending on the movement detected by the first device so that only one of the at least two presettable, stationary light spots assigned to the direction of the movement detected is generated, while the other of the at least two presettable, stationary light spots are not illuminated.

14. The firearm as recited in claim 13, further comprising:
a plurality of separate light sources each of which is configured to generate one of the at least two presettable, stationery light spots.

15. The firearm as recited in claim 1, wherein the first device comprises an electromechanical movement sensor or an electronic movement sensor.

16. A method for improving an accuracy that can be achieved using the firearm as recited in claim 1 when firing at a target moving transversely to a firing direction with a horizontal component, the sight line being aimed at the target, the method comprising:

determining a presettable angular amount by which the course of the sight line is to be altered counter to the movement direction when the firearm is moved in the horizontal plane; and altering the course of the sight line by the presettable angular amount counter to the movement direction when the firearm is moved in the horizontal plane.

17. The method as recited in claim 16, wherein the presettable angular amount is preset at a value of from 0° to 5.0°.

* * * * *